US007365742B2

(12) United States Patent
Kim et al.

(10) Patent No.: US 7,365,742 B2
(45) Date of Patent: Apr. 29, 2008

(54) LIGHT EMITTING DISPLAY AND DRIVING METHOD THEREOF

(75) Inventors: Yang-Wan Kim, Suwon-si (KR); Oh-Kyong Kwon, Seoul (KR); Sang-Moo Choi, Suwon-si (KR); Choon-Yul Oh, Suwon-si (KR); Kyoung-Do Kim, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 591 days.

(21) Appl. No.: 10/963,389

(22) Filed: Oct. 11, 2004

(65) Prior Publication Data

US 2005/0110730 A1 May 26, 2005

(30) Foreign Application Priority Data

Nov. 24, 2003 (KR) ..... 10-2003-0083573
Nov. 27, 2003 (KR) ..... 10-2003-0085067

(51) Int. Cl.
*G09G 5/00* (2006.01)

(52) U.S. Cl. ..... 345/204; 345/82; 315/169.3

(58) Field of Classification Search ..... 315/169.1, 315/169.2, 169.3; 345/76, 82, 204, 211–214
See application file for complete search history.

(56) References Cited

U.S. PATENT DOCUMENTS 5,952,789 A 9/1999 Stewart et al.
6,229,506 B1 * 5/2001 Dawson et al. ..... 345/82
6,373,454 B1 * 4/2002 Knapp et al. ..... 345/76
6,384,804 B1 5/2002 Dodabalapur et al.
6,577,302 B2 * 6/2003 Hunter et al. ..... 345/204
6,858,992 B2 * 2/2005 Park et al. ..... 315/169.3

(Continued)

FOREIGN PATENT DOCUMENTS

EP 10220 191 A2 7/2002

(Continued)

OTHER PUBLICATIONS

Korean Patent Abstract, Publication No. 100370286, Published Jul. 7, 2002, in the name of O Gyeong Kwon.

(Continued)

*Primary Examiner*—Thuy V. Tran
*Assistant Examiner*—Jimmy Vu
(74) *Attorney, Agent, or Firm*—Christie, Parker & Hale, LLP

(57) ABSTRACT

A light emitting display including data lines for applying data voltages corresponding to video signals, scan lines for transmitting select signals, and pixel circuits. Each pixel circuit includes a light emitting element for emitting light, and a transistor including first to third electrodes, for controlling a current output to the third electrode according to a voltage between the first and second electrodes. Each pixel circuit also includes a first switch for diode-connecting the transistor, a capacitor having a first electrode coupled to the first electrode of the transistor, a second switch for applying a corresponding said data voltage to the second electrode of the capacitor in response to a corresponding said select signal from a corresponding said scan line, and a third switch for substantially electrically decoupling the second electrode of the capacitor from a power supply voltage source.

22 Claims, 6 Drawing Sheets

U.S. PATENT DOCUMENTS

| | | | | |
|---|---|---|---|---|
| 7,061,451 | B2 * | 6/2006 | Kimura | 345/76 |
| 2002/0021293 | A1 | 2/2002 | Tam | |
| 2002/0089357 | A1 | 7/2002 | Pae et al. | |
| 2003/0011584 | A1 | 1/2003 | Azami et al. | 345/55 |
| 2003/0016190 | A1 | 1/2003 | Kondo | 345/55 |
| 2003/0020705 | A1 | 1/2003 | Kondo et al. | |
| 2003/0067424 | A1 | 4/2003 | Akimoto et al. | 345/55 |
| 2003/0090446 | A1 | 5/2003 | Tagawa et al. | |
| 2003/0107536 | A1 | 6/2003 | Ishizuka et al. | |
| 2003/0112208 | A1 | 6/2003 | Okabe et al. | |
| 2003/0179164 | A1 | 9/2003 | Shin et al. | |
| 2003/0231152 | A1 | 12/2003 | Shin | |
| 2004/0026723 | A1 | 2/2004 | Miyazawa | |
| 2004/0041750 | A1 | 3/2004 | Abe | |
| 2004/0046164 | A1 | 3/2004 | Kobayashi et al. | |
| 2004/0051685 | A1 | 3/2004 | Chung et al. | |
| 2004/0070557 | A1 | 4/2004 | Asano et al. | |
| 2004/0090434 | A1 | 5/2004 | Miyazawa | |
| 2004/0095168 | A1 | 5/2004 | Miyazawa | |
| 2004/0095298 | A1 | 5/2004 | Miyazawa | |
| 2004/0095338 | A1 | 5/2004 | Miyazawa | |
| 2004/0174354 | A1 | 9/2004 | Ono et al. | 345/204 |

FOREIGN PATENT DOCUMENTS

| | | |
|---|---|---|
| EP | 10220 191 A3 | 9/2003 |
| JP | 2003-122301 | 4/2003 |
| JP | 2003-173165 | 6/2003 |
| JP | 2003-195809 | 7/2003 |
| JP | 2003-223138 | 8/2003 |
| JP | 2004-133240 | 4/2004 |
| JP | 2004-286816 | 10/2004 |
| KR | 10-0370286 | 7/2002 |

OTHER PUBLICATIONS

Patent Abstract of Japan, Publication No. 2003173165, Published Jun. 20, 2003, in the name of Aoki Yoshiaaki.

European Search Report of EP 04 090 383.3, dated Nov. 30, 2005, corresponding in U.S. Appl. No. 10/963,389.

European Search Report of EP 04 090 384.1, dated Dec. 14, 2005, corresponding to U.S. Appl. No. 10/919,693.

Choi, S., et al., *An Improved Voltage Programmed Pixel Structure for Large Sizes and High Resolution AM-OLED Displays*, SID 04 Digest, 2004, pp. 260-263, XP-001222795.

Patent Abstracts of Japan, Publication No. 2003-122301, dated Apr. 25, 2003, in the name of Hajime Akimoto et al.

Patent Abstracts of Japan, Publication No. 2003-195809, dated Jul. 9, 2003, in the name of Tomoyuki Maeda.

Patent Abstracts of Japan, Publication No. 2003-223138, dated Aug. 8, 2003, in the name of Hajime Kimura.

Patent Abstracts of Japan, Publication No. 2004-133240, dated Apr. 30, 2004, in the name of Shin Asano et al.

Patent Abstracts of Japan, Publication No. 2004-286816, dated Oct. 14, 2004, in the name of Yoshiaki Aoki.

* cited by examiner

FIG.1 PRIOR ART
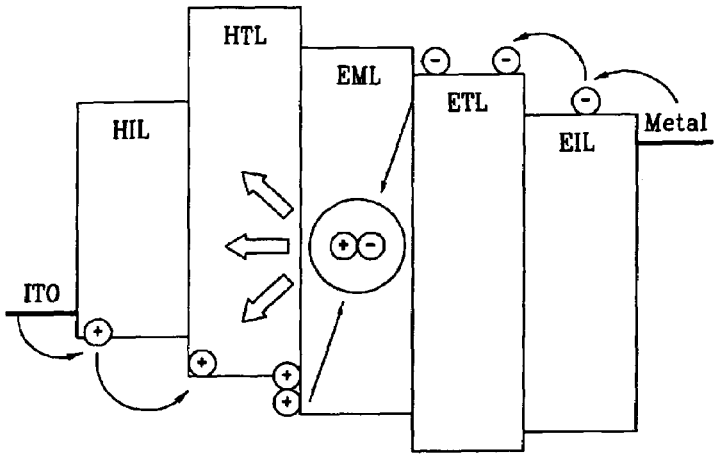
FIG.2 PRIOR ART
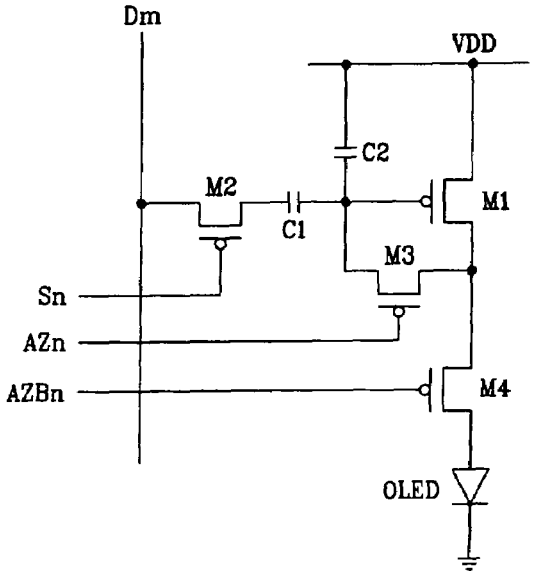

LIGHT EMITTING DISPLAY AND DRIVING METHOD THEREOF

CROSS REFERENCE TO RELATED APPLICATION

This application claims priority to and the benefit of Korea Patent Application No. 10-2003-0083573 filed on Nov. 24, 2003 and Korea Patent Application No. 10-2003-0085067 filed on Nov. 27, 2003 in the Korean Intellectual Property Office, the entire contents of both of which are incorporated herein by reference.

BACKGROUND OF THE INVENTION (a) Field of the Invention

The present invention relates to a light emitting display and a driving method thereof. More specifically, the present invention relates to an organic electroluminescent (EL) display.

(b) Description of the Related Art

In general, an organic EL display electrically excites a phosphorous organic compound to emit light, and it voltage- or current-drives N×M organic emitting cells to display images. As shown in FIG. 1, the organic emitting cell includes an anode (e.g., indium tin oxide (ITO)), an organic thin film, and a cathode layer (metal). The organic thin film has a multi-layer structure including an emitting layer (EML), an electron transport layer (ETL), and a hole transport layer (HTL) for maintaining balance between electrons and holes and improving emitting efficiencies. Further, the organic emitting cell includes an electron injecting layer (EIL) and a hole injecting layer (HIL).

Methods for driving the organic emitting cells include a passive matrix method, and an active matrix method using thin film transistors (TFTs) or metal-oxide semiconductor field-effect transistors (MOSFETs). In the passive matrix method, cathodes and anodes are arranged to cross (i.e., cross over or intersect) with each other, and lines are selectively driven. In the active matrix method, a TFT and a capacitor are coupled to each ITO pixel electrode to thereby maintain a predetermined voltage according to capacitance of the capacitor. The active matrix method is classified as a voltage programming method or a current programming method according to signal forms supplied for programming a voltage in the capacitor.

FIG. 2 shows a conventional pixel circuit of a voltage programming method for driving an organic EL element (OLED), and FIG. 3 shows a driving waveform diagram for driving the pixel circuit shown in FIG. 2.

As shown in FIG. 2, the conventional pixel circuit following the voltage programming method includes transistors M1, M2, M3, and M4, capacitors C1 and C2, and an OLED.

The transistor M1 controls the current flowing to a drain according to a voltage applied between a gate and a source, and the transistor M2 programs a data voltage to the capacitor C1 in response to a select signal from a scan line $S_n$. The transistor M3 diode-connects the transistor M1 in response to a select signal from a scan line $AZ_n$. The transistor M4 transmits the current of the transistor M1 to the OLED in response to a select signal from a scan line $AZB_n$.

The capacitor C1 is coupled between the gate of the transistor M1 and a drain of the transistor M2, and the capacitor C2 is coupled between the gate and the source of the transistor M1.

An operation of the conventional pixel circuit will be described with reference to FIG. 3.

When the transistor M3 is turned on by the select signal from the scan line $AZ_n$, the transistor M1 is diode-connected, and a threshold voltage of the transistor M1 is stored in the capacitor C2.

When the transistor M3 is turned off and a data voltage is applied, a voltage that corresponds to a summation of a variation of the data voltage applied to the data line Dm and the threshold voltage of the driving transistor M1 is stored in the capacitor C2 because of a boosting operation by the capacitor C1. When the transistor M4 is turned on, a current corresponding to the data voltage flows to the OLED.

The conventional pixel circuit uses two capacitors C1 and C2 and transistors M3 and M4 to compensate for deviations of the threshold voltage of the transistor M1, but the pixel circuit and a driving circuit become complicated and an aperture ratio of the light emitting display is reduced since the conventional pixel circuit requires three different scan lines. Also, since the data is programmed after the deviation of the threshold voltage is compensated during a single pixel selecting time, it is difficult to apply the pixel circuit to a high-resolution panel because of a data charging problem.

SUMMARY OF THE INVENTION

In an exemplary embodiment of the present invention, a pixel circuit of a light emitting display is driven using a lesser number of signal lines.

In another exemplary embodiment of the present invention, a pixel circuit is simplified, thereby improving an aperture ratio of the light emitting display.

In still another exemplary embodiment of the present invention, a method for driving a light emitting display applicable to a high-resolution panel is provided.

In an aspect of the present invention, is provided a light emitting display including a plurality of data lines for applying data voltages corresponding to video signals, a plurality of scan lines for transmitting select signals, and a plurality of pixel circuits coupled to the scan lines and the data lines. Each said pixel circuit includes a light emitting element for emitting a light beam corresponding to a current, which is applied thereto, and a transistor including a first electrode, a second electrode coupled to a power supply voltage source, and a third electrode coupled to the light emitting element, for controlling the current output to the third electrode according to a voltage applied between the first and second electrodes. Each said pixel circuit also includes a first switch for diode-connecting the transistor in response to a first control signal, and a capacitor having a first electrode coupled to the first electrode of the transistor. A second switch applies a corresponding said data voltage to the second electrode of the capacitor in response to a corresponding said select signal from a corresponding said scan line. A third switch coupled between the second electrode of the capacitor and the power supply voltage source substantially electrically decouples the second electrode of the capacitor from the power supply voltage source in response to a second control signal.

The first and second switches may include transistors of the same type of channel, and the first control signal may be the corresponding said select signal from the corresponding said scan line or another signal which is substantially the same as the corresponding said select signal.

The third switch may include a transistor having a channel type which is different from that of the first switch, and the second control signal may be the corresponding said select signal from the corresponding said scan line or another signal which is substantially the same as the corresponding said select signal.

The light emitting display may further include a fourth switch for substantially electrically decoupling the third electrode of the transistor from the light emitting element in response to a third control signal.

The fourth switch may include a transistor having a channel type different from that of the first switch, and the third control signal may be the corresponding said select signal from the corresponding said scan line or another signal which is substantially the same as the corresponding said select signal.

The fourth switch may include a transistor having a channel type which is the same as that of the third switch, and the third control signal may be the second control signal or another signal which is substantially the same as the second control signal.

The third and fourth switches may be turned on at substantially the same time, when the first and second switches are turned on at substantially the same time.

In another aspect of the present invention, is provided a display panel of a light emitting display including a plurality of data lines for applying data voltages corresponding to video signals, a plurality of scan lines for transmitting select signals, and a plurality of pixel circuits coupled to the data lines and the scan lines. Each said pixel circuit includes a light emitting element for emitting a light beam corresponding to a current, which is applied thereto, a transistor including a first electrode, a second electrode coupled to a power supply voltage source, and a third electrode coupled to the light emitting element, for controlling the current output to the third electrode according to a voltage applied between the first and second electrodes, and a capacitor having a first electrode coupled to the first electrode of the first transistor. Each said pixel also includes a switch for applying a corresponding said data voltage to the second electrode of the capacitor in response to a corresponding said select signal from a corresponding said scan line. Each said pixel circuit is operated in order of: a first period during which the corresponding said data voltage is applied to the second electrode of the capacitor by the corresponding said select signal from the corresponding said scan line, and the transistor is diode-connected; and a second period during which the second electrode of the capacitor is electrically coupled to the power supply voltage source, and the current, which is output by the transistor, is provided to the light emitting element.

In still another aspect of the present invention, is provided a method for driving a light emitting display including a plurality of data lines for applying data voltages corresponding to video signals, a plurality of scan lines for transmitting select signals, and a plurality of pixel circuits coupled to the scan lines and the data lines. Each said pixel circuit includes a transistor including a first electrode, a second electrode coupled to a power supply voltage source, and a third electrode, for outputting a current corresponding to a voltage applied between the first and second electrodes to the third electrode, a capacitor having a first electrode coupled to the first electrode of the transistor, and a light emitting element coupled to the third electrode of the transistor. The method includes: (a) applying a corresponding said data voltage to the second electrode of the capacitor in response to a corresponding said select signal; (b) applying a threshold voltage of the transistor between the first electrode of the capacitor and the second electrode of the transistor; and (c) electrically coupling the second electrode of the capacitor to the power supply voltage source in response to a first control signal.

BRIEF DESCRIPTION OF THE DRAWINGS

The accompanying drawings, together with the specification, illustrate exemplary embodiments of the present invention, and, together with the description, serve to explain the principles of the present invention:

FIG. 1 shows a conceptual diagram of an organic EL element;

FIG. 2 shows a conventional voltage programming method based pixel circuit;

DETAILED DESCRIPTION

In the following detailed description, only certain exemplary embodiments of the present invention are shown and described, simply by way of illustration. As those skilled in the art would realize, the described embodiments may be modified in various different ways, all without departing from the spirit or scope of the present invention. Accordingly, the drawings and description are to be regarded as illustrative in nature, and not restrictive.

Figure 3:
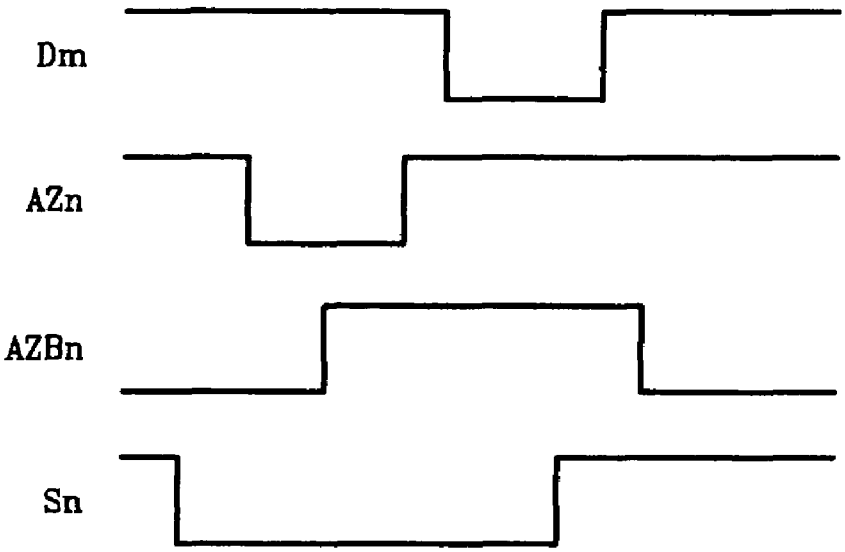
FIG.3 PRIOR ART
FIG. 3 shows a driving waveform diagram for driving the pixel circuit shown in FIG. 2.
Figure 4:
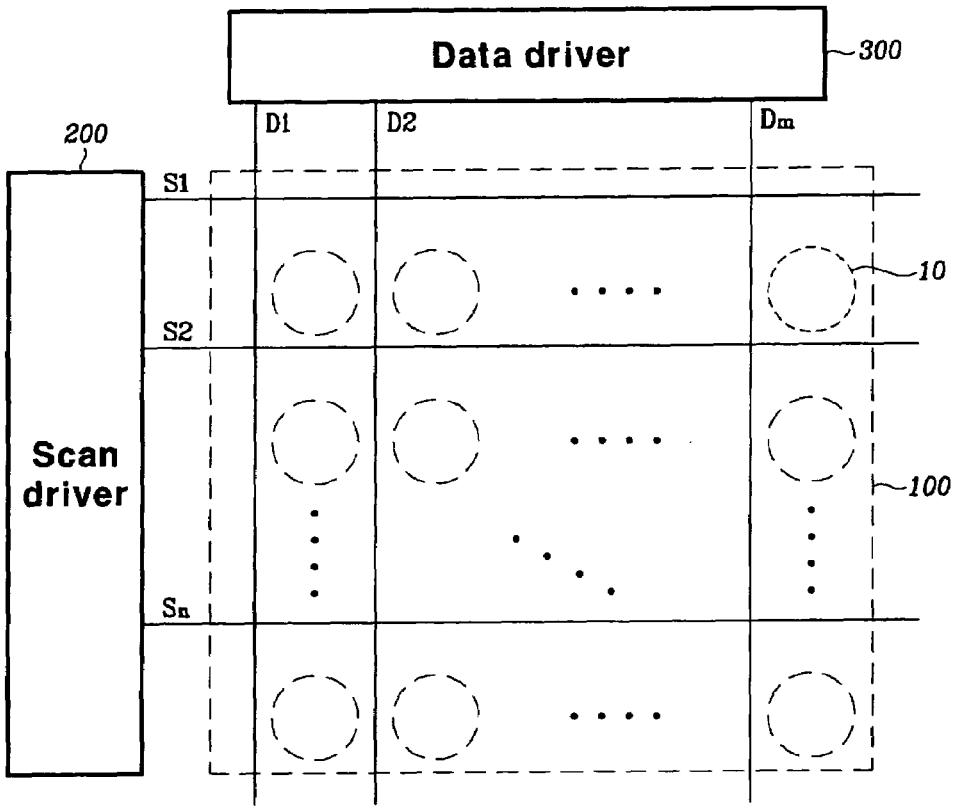
FIG. 4 shows a brief diagram of an active matrix display according to an exemplary embodiment of the present invention.

FIG. 4 shows a brief diagram of an active matrix display according to an exemplary embodiment of the present invention.

As shown, the active matrix display includes an organic EL display panel 100, a scan driver 200, and a data driver 300.

The organic EL display panel 100 includes a plurality of data lines $D_1$ to $D_m$ arranged in the column direction, a plurality of scan lines $S_1$ to $S_n$ arranged in the row direction, and a plurality of pixel circuits 10. The data lines $D_1$ to $D_m$ transmit data signals that display video signals to the pixel circuits 10, and the scan lines $S_1$ to $S_n$ transmit select signals to the pixel circuits 10. Each of the pixel circuits 10 is formed at a pixel region defined by two adjacent data lines $D_1$ to $D_m$ and two adjacent scan lines $S_1$ to $S_n$.

The scan driver 200 sequentially applies the select signals to the scan lines $S_1$ to $S_n$, and the data driver 300 applies data voltages that correspond to the video signals to the data lines $D_1$ to $D_m$.

The scan driver 200 and/or the data driver 300 may be coupled to the display panel 100, or may be installed, in a chip format, in a tape carrier package (TCP) coupled to the display panel 100. Further, the scan driver 200 and/or the data driver 300 may be attached to the display panel 100, and installed, in a chip format, on a flexible printed circuit (FPC) or a film coupled to the display panel 100. Alternatively, the scan driver 200 and/or the data driver 300 may be installed on the glass substrate of the display panel, and further, the same may be substituted for the driving circuit formed in the same layers of the scan lines, the data lines, and TFTs on the glass substrate, or directly installed on the glass substrate.

Figure 5:
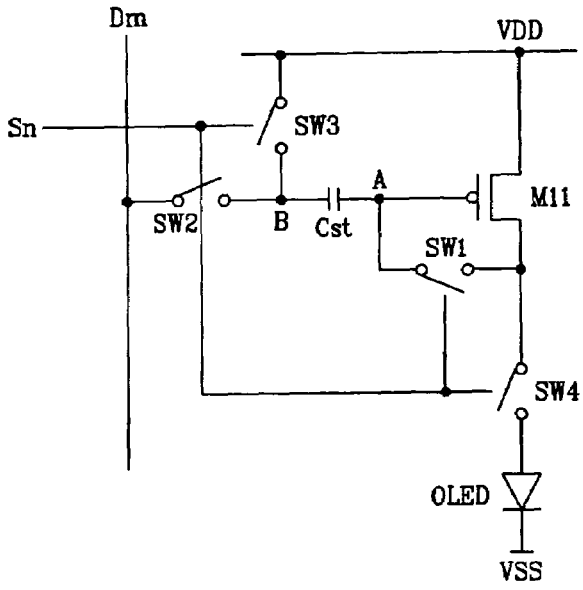
FIG. 5 shows a pixel circuit according to a first exemplary embodiment of the present invention.
Figure 6:
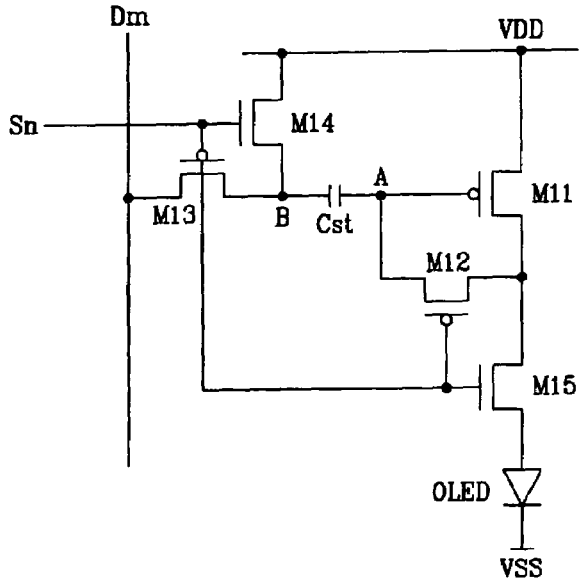
FIG. 6 shows a detailed diagram of the pixel circuit shown in FIG. 5.
Figure 7:
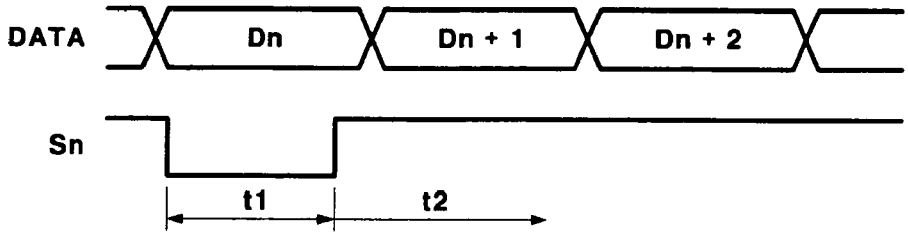
FIG. 7 shows a driving waveform diagram for driving the pixel circuit according to a first exemplary embodiment of the present invention.

Referring to FIGS. 5 to 7, one of the pixel circuits 10 of the organic EL display according to a first exemplary embodiment of the present invention will be described in detail.

FIG. 5 shows an equivalent circuit diagram of the pixel circuit according to the first exemplary embodiment of the present invention, FIG. 6 shows a detailed diagram of the pixel circuit shown in FIG. 5, and FIG. 7 shows a driving waveform diagram for driving the pixel circuit shown in FIG. 6. For ease of description, the pixel circuit coupled to the $m^{th}$ data line $D_m$ and the $n^{th}$ scan line $S_n$ is illustrated in FIGS. 5 and 6. It should be noted, however, that all of the other pixel circuits 10 in FIG. 4 have substantially the same configuration and operate in substantially the same manner.

As shown in FIG. 5, the pixel circuit 10 according to the first exemplary embodiment of the present invention includes a transistor M1, switches SW1, SW2, SW3 and SW4, a capacitor $C_{st}$, and an OLED. The transistor M11 is illustrated as a transistor having a P-type channel in FIG. 5. In other embodiments, the transistor M11 may be replaced with a transistor having an N-type channel, as those skilled in the art would realize.

The transistor M11 is coupled between a power supply voltage source $V_{DD}$ and the OLED, and controls the current flowing to the OLED. In detail, a source of the transistor M11 is coupled to the power supply voltage source $V_{DD}$, and a drain is coupled to an anode of the OLED through the switch SW4. A cathode of the OLED can be grounded, and coupled to a voltage source having a voltage level which is lower than that of the power supply voltage source $V_{DD}$. Also, a gate of the transistor M11 is coupled to a first electrode A of the capacitor $C_{st}$, and a second electrode B of the capacitor $C_{st}$ is coupled to the switch SW2.

The switch SW2 allows a voltage of the data line $D_m$ to be applied to the second electrode B of the capacitor $C_{st}$ in response to the select signal from the scan line $S_n$. The switch SW1 diode-connects the transistor M11 in response to the select signal from the scan line $S_n$. The switch SW3 is coupled between the power supply voltage source $V_{DD}$ and the second electrode B of the capacitor $C_{st}$, and substantially electrically decouples the second electrode B of the capacitor $C_{st}$ from the power supply voltage source $V_{DD}$ in response to the select signal from the scan line $S_n$. The switch SW4 is coupled between the transistor M11 and the OLED, and substantially electrically decouples the transistor M11 from the OLED in response to the select signal from the scan line $S_n$.

Respective control signals are applied to the switches SW1 to SW4 according to the exemplary embodiment of the present invention. Further, the switches SW1 to SW4 are controlled by a single select signal by realizing the switches SW1 and SW2 and the switches SW3 and SW4 with transistors having different types of channels.

In detail, when attempting to program the data voltage in the case that the select signal is low-level, it is desirable to realize the switches SW1 and SW2 with the transistors M12 and M13 of the P-type channel, and the switches SW3 and SW4 with transistors M14 and M15 of the N-type channel, as shown in FIG. 6.

Also, the transistors M11 to M15 may be realized with any suitable active elements that have a first electrode, a second electrode, and a third electrode, and they control the current flowing to the third electrode from the second electrode according to the voltage applied between the first and second electrodes.

Referring to FIG. 7, the operation of the pixel circuit according to the first exemplary embodiment of the present invention will be described.

As shown, in a period t1, the select signal becomes low-level to turn on the transistor M12, and the transistor M11 is diode-connected by the transistor M12. Accordingly, the threshold voltage of the transistor M11 is applied between the gate and the source of the transistor M11. Also, the voltage that corresponds to a summation of the power supply voltage $V_{DD}$ and the threshold voltage of the transistor M11 is applied to the gate of the transistor, that is, the first electrode A of the capacitor $C_{st}$, since the source of the transistor M11 is coupled to the power supply voltage $V_{DD}$. Further, the transistor M13 is turned on, and the data voltage from the data line $D_m$ is applied to the second electrode B of the capacitor $C_{st}$.

In a period t2, the transistors M12 and M13 are turned off by a high-level select signal. The transistor M14 is turned on to apply the power supply voltage $V_{DD}$ to the second electrode B of the capacitor $C_{st}$. In this instance, the voltage at the first electrode A of the capacitor $C_{st}$ is increased by a voltage variation of the second electrode B since the voltage at the second electrode B of the capacitor $C_{st}$ is changed from the data voltage to the power supply voltage $V_{DD}$, and no current path is formed in the pixel circuit. In other words, the voltage $V_A$ applied to the first electrode A of the capacitor $C_{st}$ is given as Equation 1.

$$V_A = V_{DD} + V_{TH1} + \Delta V_B \qquad \text{Equation 1}$$

where $V_{TH1}$ is a threshold voltage of the transistor M11, and $\Delta V_B$ is a voltage variation of the second electrode B of the capacitor $C_{st}$ and is given in Equation 2.

$$\Delta V_B = V_{DD} - V_{DATA} \qquad \text{Equation 2}$$

The transistor M15 is turned on, and the current flowing to the transistor M11 is applied to the OLED to emit a light beam in the period t2. In this instance, the current applied to the OLED is given as Equation 3.

$$\begin{aligned} I_{OLED} &= \frac{\beta}{2}(V_{GS1} - V_{TH1})^2 \\ &= \frac{\beta}{2}((V_{DD} + V_{TH1} + \Delta V_B) - V_{DD} - V_{TH1})^2 \\ &= \frac{\beta}{2}(\Delta V_B)^2 = \frac{\beta}{2}(V_{DD} - V_{DATA})^2 \end{aligned} \qquad \text{Equation 3}$$

where β is a constant, and $V_{GS1}$ is a voltage between the gate and the source of the transistor M11.

As can be seen from Equation 3, since the current flowing to the OLED is not influenced by the threshold voltage $V_{TH1}$, a deviation of the threshold voltage of the driving transistor M11 provided between the pixel circuits is compensated.

Therefore, the aperture ratio is increased and the driving circuit is configured more simply since the deviation of the threshold voltage $V_{TH1}$ of the driving transistor M11 is compensated by a single scan line $S_n$.

Figure 8:
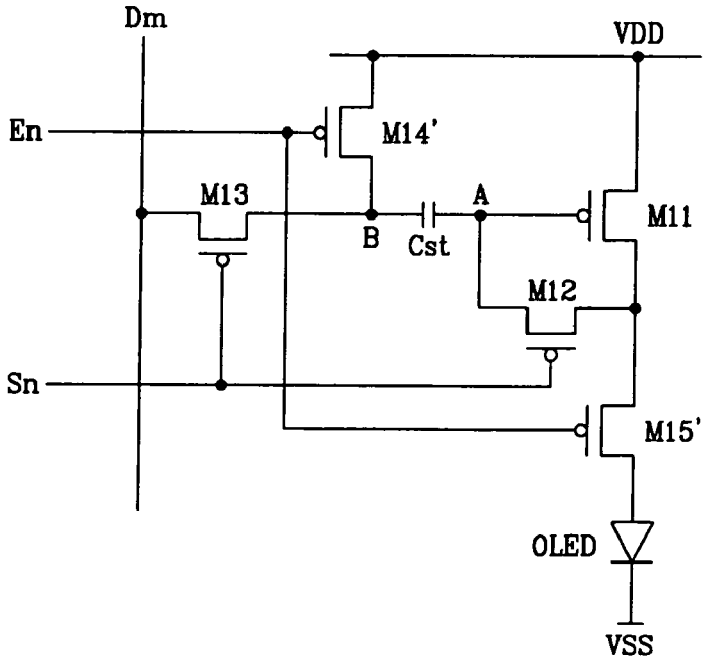
FIG. 8 shows a pixel circuit according to a second exemplary embodiment of the present invention.

The switching transistors M12, M13, M14, and M15 are controlled by a single select signal in the first exemplary embodiment. As shown in FIG. 8, a select signal from the scan line $S_n$ is applied to the transistors M12 and M13, and a select signal from the scan line $E_n$ is applied to transistors M14' and M15' in the second exemplary embodiment. The transistors M12, M13, M14', M15', the capacitor $C_{st}$ and the OLED are interconnected in substantially the same manner as the corresponding components of FIG. 6. In this case, the transistors M12, M13, M14' and M15' are realized with transistors having the same type of channel (i.e., P-channel), and a polarity of the select signal applied to the transistors M12 and M13 is different from that of the select signal applied to the transistors M14 and M15.

Figure 9:
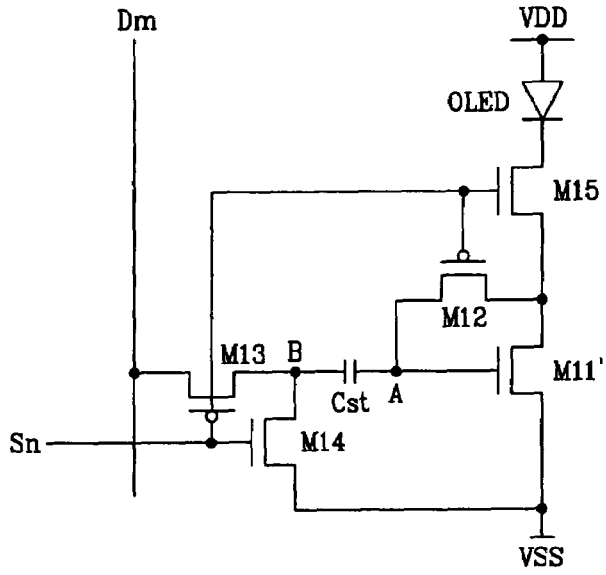
FIG. 9 shows a pixel circuit according to a third exemplary embodiment of the present invention.

As shown in FIG. 9, a driving transistor M11' is realized with a transistor having the N-type channel according to a third exemplary embodiment of the present invention. In this instance, a drain of the transistor M11' is coupled to the cathode of the OLED through the transistor M15, and the anode of the OLED is coupled to the power supply voltage source $V_{DD}$. Also, the sources of the transistors M11' and M14 are coupled to the power supply voltage source $V_{SS}$. The transistors M12, M13, M15 and the capacitor $C_{st}$ are interconnected together in substantially the same manner as the corresponding components of FIG. 6.

Figure 10:
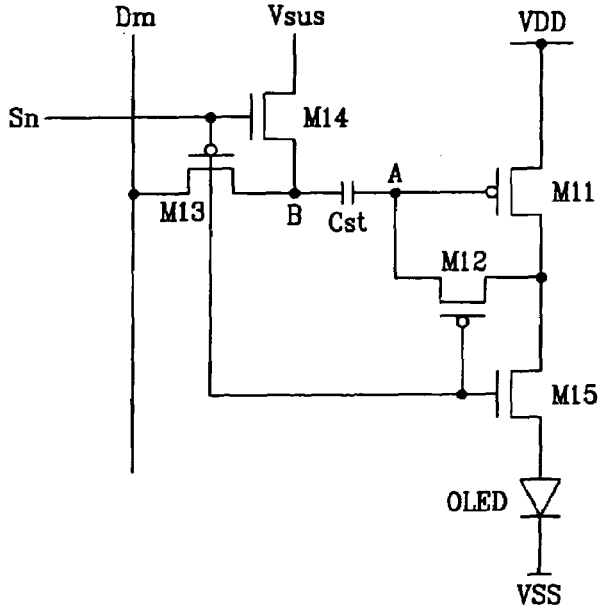
FIG. 10 shows a pixel circuit according to a fourth exemplary embodiment of the present invention.

FIG. 10 shows a pixel circuit according to a fourth exemplary embodiment of the present invention.

Since the drain of the transistor M14 in the pixel circuit according to the fourth exemplary embodiment is coupled to a compensation voltage $V_{sus}$, a deviation of the threshold voltages of the driving transistors and a deviation of the power supply voltages $V_{DD}$ between the pixel circuits are compensated.

In detail, when the select signal from the scan line $S_n$ becomes low-level, the transistors M12 and M13 are turned on, a data voltage is applied to the second electrode B of the capacitor $C_{st}$, and a voltage that corresponds to a summation of the power supply voltage $V_{DD}$ and the threshold voltage of the transistor M11 is applied to the first electrode A thereof.

When the select signal from the scan line $S_n$ becomes high-level, the transistor M14 is turned on, and the compensation voltage $V_{sus}$ is applied to the second electrode B of the capacitor $C_{st}$. In this instance, the voltage at the first electrode A of the capacitor $C_{st}$ is increased by a voltage variation of the second electrode B, and a voltage variation $\Delta V_B$ of the second electrode B of the capacitor $C_{st}$ is given as Equation 4.

$$\Delta V_B = V_{sus} - V_{DATA} \quad \text{Equation4}$$

Also, the transistor M15 is turned on, and the current flowing to the driving transistor M11 is applied to the OLED to thus emit light. The current $I_{OLED}$ applied to the OLED is given in Equation 5.

$$\begin{aligned} I_{OLED} &= \frac{\beta}{2}(V_{GS1} - V_{TH1})^2 \quad \text{Equation 5} \\ &= \frac{\beta}{2}((V_{DD} + V_{TH1} + \Delta V_B) - V_{DD} - V_{TH1})^2 \\ &= \frac{\beta}{2}(\Delta V_B)^2 = \frac{\beta}{2}(V_{sus} - V_{DATA})^2 \end{aligned}$$

As can be seen from Equation 5, the current $I_{OLED}$ flowing to the OLED is not influenced by the threshold voltage $V_{TH1}$ of the transistor M11 and the power supply voltage $V_{DD}$.

The current flowing to the OLED is influenced by the compensation voltage $V_{sus}$ in the fourth exemplary embodiment, but since no current path is formed through the compensation voltage $V_{sus}$ in the pixel circuit, substantially no voltage drop is generated when supplying the compensation voltage $V_{sus}$. Hence, substantially the same compensation voltage $V_{sus}$ is applied to all the pixels, and the desired current flows to the OLED by controlling the data voltage.

FIG. 10 shows a case where a select signal from the scan line $S_n$ is applied to all the switching transistors M12 to M15. However, different control signals may be applied to the respective transistors in other exemplary embodiments. Also, the same first control signal may be applied to the transistors M12 and M13, and the same second control signal may be applied to the transistors M14 and M15. In other embodiments, the driving transistor M11 can be replaced with a transistor having the N-type channel.

The switching transistors M14 and M15 are realized by using MOS transistors in the first to fourth exemplary embodiments. Further, other switches for switching both electrodes in response to the applied select signals can also be applied, and the channel types of the switching transistors M14 and M15 can be modified depending on the exemplary embodiments, which are obvious to a person skilled in the art.

A light emitting display with a compensated deviation of the threshold voltage of the driving transistor is provided with a lesser number of signal lines.

Also, the aperture ratio of the light emitting display is improved by simplifying the driving circuits and the pixel circuits.

Further, a method for driving a light emitting display applicable to a high resolution panel is provided.

While this invention has been described in connection certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A light emitting display including a plurality of data lines for applying data voltages corresponding to video signals, a plurality of scan lines for transmitting select signals, and a plurality of pixel circuits coupled to the scan lines and the data lines, each said pixel circuit comprising:

a light emitting element for emitting a light beam corresponding to a current, which is applied thereto;

a transistor including a first electrode, a second electrode coupled to a power supply voltage source, and a third electrode coupled to the light emitting element, for controlling the current output to the third electrode according to a voltage applied between the first and second electrodes;

a first switch for diode-connecting the transistor in response to a first control signal;

a capacitor having a first electrode coupled to the first electrode of the transistor;

a second switch for applying a corresponding said data voltage to the second electrode of the capacitor in response to a corresponding said select signal from a corresponding said scan line; and a third switch coupled between the second electrode of the capacitor and the power supply voltage source, for substantially electrically decoupling the second electrode of the capacitor from the power supply voltage source in response to a second control signal.

2. The light emitting display of claim 1, wherein the first and second switches include transistors of the same type of channel, and the first control signal is the corresponding said select signal from the corresponding said scan line or another signal which is substantially the same as the corresponding said select signal.

3. The light emitting display of claim 1, wherein the third switch includes a transistor having a channel type which is different from that of the first switch, and the second control signal is the corresponding said select signal from the corresponding said scan line or another signal which is substantially the same as the corresponding said select signal.

4. The light emitting display of claim 1, further comprising a fourth switch for substantially electrically decoupling the third electrode of the transistor from the light emitting element in response to a third control signal.

5. The light emitting display of claim 4, wherein the fourth switch includes a transistor having a channel type different from that of the first switch, and the third control signal is the corresponding said select signal from the corresponding said scan line or another signal which is substantially the same as the corresponding said select signal.

6. The light emitting display of claim 4, wherein the fourth switch includes a transistor having a channel type which is the same as that of the third switch, and the third control signal is the second control signal or another signal which is substantially the same as the second control signal.

7. The light emitting display of claim 1, wherein the third and fourth switches are turned on at substantially the same time, when the first and second switches are turned on at substantially the same time.

8. The light emitting display of claim 1, wherein the transistor has a P-type channel, the first electrode is a gate electrode, the second electrode is a source electrode, and the third electrode is a drain electrode.

9. The light emitting display of claim 1, wherein the transistor has an N-type channel, the first electrode is a gate electrode, the second electrode is a drain electrode, and the third electrode is a source electrode.

10. The light emitting display of claim 1, wherein an anode of the light emitting element is coupled to the third electrode of the transistor, and a cathode of the light emitting element is coupled to a second power supply voltage source.

11. The light emitting display of claim 10, wherein a voltage level of the second power supply voltage source is lower than that of the data voltage.

12. A display panel of a light emitting display including a plurality of data lines for applying data voltages corresponding to video signals, a plurality of scan lines for transmitting select signals, and a plurality of pixel circuits coupled to the data lines and the scan lines, each said pixel circuit comprising:

a light emitting element for emitting a light beam corresponding to a current, which is applied thereto;

a transistor including a first electrode, a second electrode coupled to a power supply voltage source, and a third electrode coupled to the light emitting element, for controlling the current output to the third electrode according to a voltage applied between the first and second electrodes;

a capacitor having a first electrode coupled to the first electrode of the first transistor; and a switch for applying a corresponding said data voltage to the second electrode of the capacitor in response to a corresponding said select signal from a corresponding said scan line, wherein each said pixel circuit is operated in an order of:

a first period during which the corresponding said data voltage is applied to the second electrode of the capacitor by the corresponding said select signal from the corresponding said scan line, and the transistor is diode-connected; and a second period during which the second electrode of the capacitor is electrically coupled to the power supply voltage source, and the current, which is outputted by the transistor, is provided to the light emitting element.

13. The display panel of claim 12, wherein the light emitting element and the third electrode of the transistor are substantially electrically decoupled during the first period.

14. The display panel of claim 12, wherein an anode of the light emitting element is coupled to the third electrode of the transistor, and a cathode of the light emitting element is coupled to a second power supply voltage source.

15. The display panel of claim 14, wherein a voltage level of the second power supply voltage source is lower than that of the corresponding said data voltage.

16. A method for driving a light emitting display including a plurality of data lines for applying data voltages corresponding to video signals, a plurality of scan lines for transmitting select signals, and a plurality of pixel circuits coupled to the scan lines and the data lines, each said pixel circuit comprising: a transistor including a first electrode, a second electrode coupled to a power supply voltage source, and a third electrode, for outputting a current corresponding to a voltage applied between the first and second electrodes to the third electrode; a capacitor having a first electrode coupled to the first electrode of the transistor; and a light emitting element coupled to the third electrode of the transistor, the method comprising:

(a) applying a corresponding said data voltage to the second electrode of the capacitor in response to a corresponding said select signal;

(b) applying a threshold voltage of the transistor between the first electrode of the capacitor and the second electrode of the transistor; and (c) electrically coupling the second electrode of the capacitor to the power supply voltage source in response to a first control signal.

17. The method of claim 16, wherein the third electrode of the transistor and the light emitting element are substantially electrically decoupled while performing step (a).

18. The method of claim 16, wherein the first control signal is a corresponding said select signal from a corresponding scan line or a signal which is substantially the same as the corresponding said select signal.

19. The method of claim 16, wherein the transistor has a P-type channel, the first electrode is a gate electrode, the second electrode is a source electrode, and the third electrode is a drain electrode.

20. The method of claim 16, wherein the transistor has an N-type channel, the first electrode is a gate electrode, the second electrode is a drain electrode, and the third electrode is a source electrode.

21. The method of claim 16, wherein an anode of the light emitting element is coupled to the third electrode of the transistor, and a cathode of the light emitting element is coupled to a second power supply voltage source.

22. The method of claim 21, wherein a voltage level of the second power supply voltage source is lower than that of the corresponding said data voltage.

* * * * *